US007562551B2

(12) United States Patent
Kong

(10) Patent No.: US 7,562,551 B2
(45) Date of Patent: Jul. 21, 2009

(54) PRESS DIE SET FOR A MULTI-STEP PRESS SYSTEM

(75) Inventor: Moon-Gyu Kong, Anyang-si (KR)

(73) Assignee: GNS Co., Ltd. (KR)

( * ) Notice: Subject to any disclaimer, the term of this patent is extended or adjusted under 35 U.S.C. 154(b) by 369 days.

(21) Appl. No.: 11/715,126

(22) Filed: Mar. 7, 2007

(65) Prior Publication Data

US 2008/0216546 A1 Sep. 11, 2008

(51) Int. Cl.
*B21J 11/00* (2006.01)
*B30B 15/30* (2006.01)

(52) U.S. Cl. ..... 72/405.13; 100/207

(58) Field of Classification Search ..... 72/405.01, 72/405.05, 405.06, 405.07, 405.09, 405.11–405.13, 72/405.16, 355.2, 358, 361, 446, 481.6, 481.7; 198/621.1; 100/207, 918
See application file for complete search history.

(56) References Cited

U.S. PATENT DOCUMENTS

| | | | | |
|---|---|---|---|---|
| 5,121,623 | A * | 6/1992 | Brzezniak | 72/405.13 |
| 5,727,416 | A | 3/1998 | Allgoewer | |
| 6,105,414 | A | 8/2000 | Yamada et al. | |
| 6,200,245 | B1 | 3/2001 | Dodo et al. | |

FOREIGN PATENT DOCUMENTS

| | | | |
|---|---|---|---|
| JP | 03-043959 | B2 | 4/1985 |
| JP | 07-100540 | A | 4/1995 |
| JP | 07-155874 | A | 6/1995 |
| KR | 10-1983-0001698 | A | 5/1983 |
| KR | 10-1999-0083488 | A | 11/1999 |
| KR | 10-0258712 | B1 | 12/2000 |
| KR | 10-0346866 | B1 | 11/2002 |
| KR | 10-2003-0060058 | A | 7/2003 |
| KR | 10-0550717 | B1 | 2/2006 |

* cited by examiner

*Primary Examiner*—Dana Ross
*Assistant Examiner*—Teresa Bonk
(74) *Attorney, Agent, or Firm*—Knobbe Martens Olson & Bear LLP

(57) ABSTRACT

A press die set for a multi-step press system includes a lower die attached to a table and an upper die attached to a ram, the lower die and the upper die being adapted to simultaneously press-form workpieces placed in press-forming stations. The lower die includes a base attached to the table, plural pairs of guide rails fixedly secured to a top surface of the base, each pair of guide rails having mutually opposing grooves, a plurality of first die segments for press-forming the workpieces into desired shapes, each of the die segments having a slider plate removably inserted into the grooves of each pair of guide rails, and a plurality of clamping units provided on opposite lateral sides of each pair of guide rails for clamping the slider plate against removal. The upper die has substantially the same structure as that of the lower die.

5 Claims, 6 Drawing Sheets

PRESS DIE SET FOR A MULTI-STEP PRESS SYSTEM

BACKGROUND

1. Field

The present invention relates to a multi-step press system and, more particularly, to a press die set for use in a multi-step press system that can simultaneously press-form workpieces placed on a plurality of press-forming stations through a single pressing stroke.

2. Discussion of the Related Technology

A press refers to a machine for manufacturing products by shearing, forming and squeezing a material such as a metal plate, a plastic, a fiber and the like. The press is suitable for use in mass production of articles and finds extensive applications in a variety of industrial fields. Press die sets of varying structures are employed in the press for the purpose of cutting, punching, blanking, piercing, bending, drawing and embossing workpieces. Each of the press die sets includes an upper die attached to a ram of the press and a lower die secured to a table thereof. The press die sets are often called a punch, a cutter or other names depending on the functions performed by them.

In the meantime, a multi-step press system is known in the art, which system is designed to load workpieces into a plurality of press-forming stations one after another and then press-form them into final products. The multi-step press system includes a press die comprised of a plurality of transfer dies corresponding to press-forming stations, each of the transfer dies having a set of upper and lower die members.

Such a press die for a multi-step press system is disclosed in Korean Patent Laid-open Publication No. 2000-70458 wherein an upper die member and a lower die member are removably attached to a die holder by means of a clamp. However, this poses a problem in that press die fabrication costs are increased due to the use of the die holder for clamping the upper die member and the lower die member. Another problem is that the task of attaching and removing the upper die member and the lower die member in individual press-forming stations are time-consuming and labor-intensive. A further problem is that the press die becomes expensive due to the difficulties encountered in developing, designing and fabricating the same.

The discussion in this section is to provide general background information, and does not constitute an admission of prior art.

SUMMARY

An aspect of the present invention provides a press die set for a multi-step press system that can simultaneously press-form workpieces placed on a plurality of press-forming stations through a single pressing stroke, thereby improving productivity, and further that allows a plurality of die segments forming an upper die and a lower die of the press die set to be readily attached and removed in a cartridge-like manner.

Another aspect of the present invention provides a press die set for a multi-step press system capable of shortening the die change time, enhancing the ease of work and the interchangeability of components.

A further aspect of the present invention provides a press die set for a multi-step press system that helps to shorten the time period required in developing and designing the press die set, thereby making the press die set less costly.

One aspect of the present invention provides a press die set for a multi-step press system wherein the press system is comprised of: a press including a table having a plurality of press-forming stations in which workpieces are sequentially press-formed, the press-forming stations being serially arranged in an X-axis direction, and a ram provided above the table for making rectilinear reciprocating movement in a Z-axis direction; and a transfer feeder provided between the table and the ram for simultaneously picking up the workpieces placed in the press-forming stations and transferring the workpieces in a downstream direction, the press die set comprising: a lower die attached to the table and an upper die attached to the ram, the lower die and the upper die being adapted to simultaneously press-form the workpieces placed in the press-forming stations, wherein the lower die includes a first base attached to the table, plural pairs of first guide rails fixedly secured to a top surface of the first base and arranged in a Y-axis direction, each pair of first guide rails having mutually opposing grooves, a plurality of first die segments for making direct contact with the workpieces to press-form the workpieces into desired shapes, each of the first die segments having a slider plate removably inserted into the grooves of each pair of first guide rails, and a plurality of first clamping units provided on opposite lateral sides of each pair of first guide rails for clamping the slider plate of each of the first die segments against removal, and wherein the upper die includes a second base attached to the ram, plural pairs of second guide rails fixedly secured to a bottom surface of the second base and arranged in the Y-axis direction, each pair of second guide rails having mutually opposing grooves, a plurality of second die segments for making direct contact with the workpieces to press-form the workpieces into desired shapes, each of the second die segments having a slider plate removably inserted into the grooves of each pair of second guide rails, and a plurality of second clamping units provided on opposite lateral sides of each pair of second guide rails for clamping the slider plate of each of the second die segments against removal.

BRIEF DESCRIPTION OF THE DRAWINGS

The above and other aspects and features of the present invention will become apparent from the following description of embodiments, given in conjunction with the accompanying drawings, in which.

DETAILED DESCRIPTION OF EMBODIMENTS

Various embodiments of the present invention will now be described with reference to the accompanying drawings.

Figure 1:
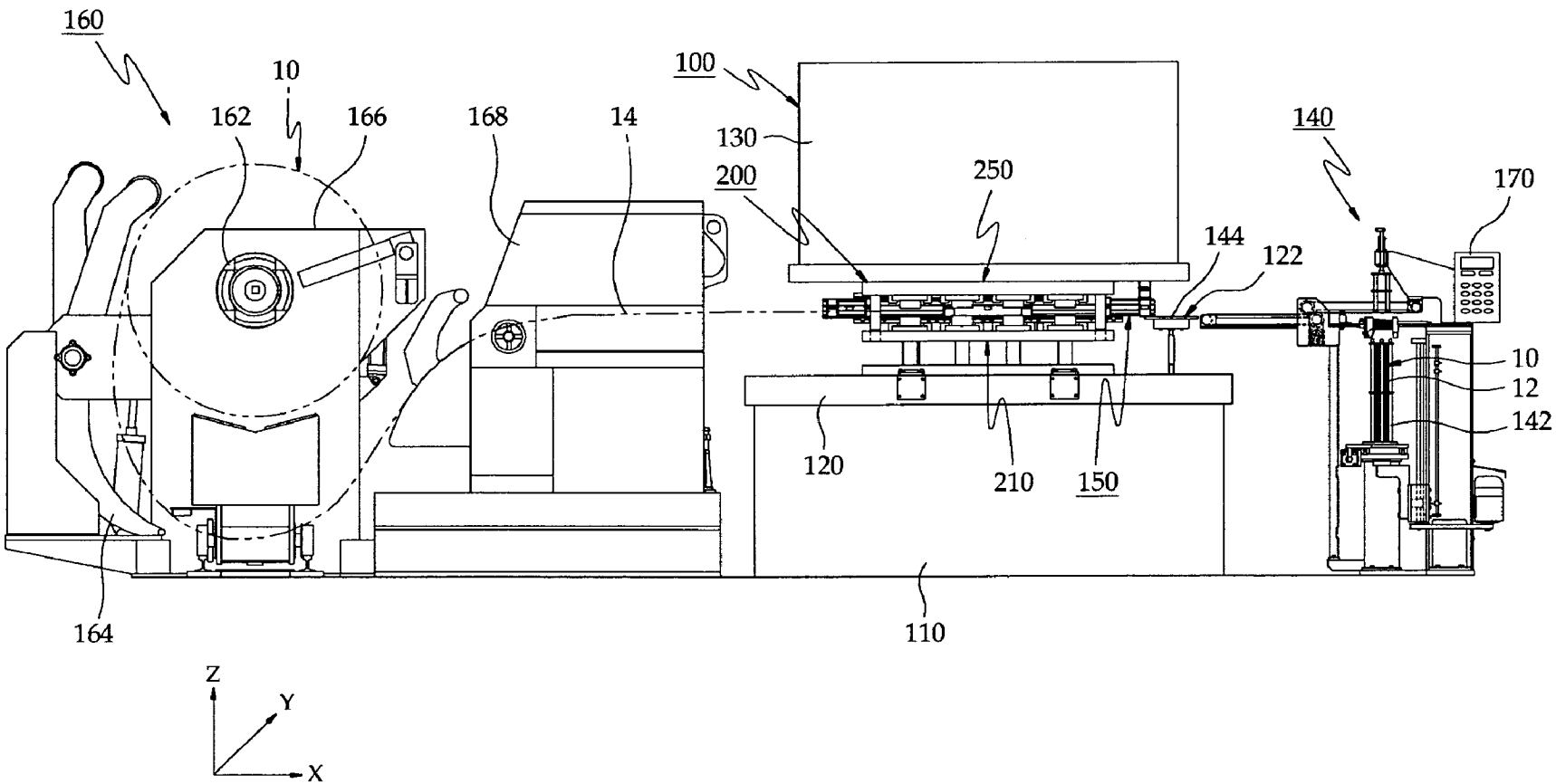
FIG. 1 is a front elevational view showing the overall configuration of a multi-step press system that employs a press die set in accordance with an embodiment of the present invention.
Figure 2:
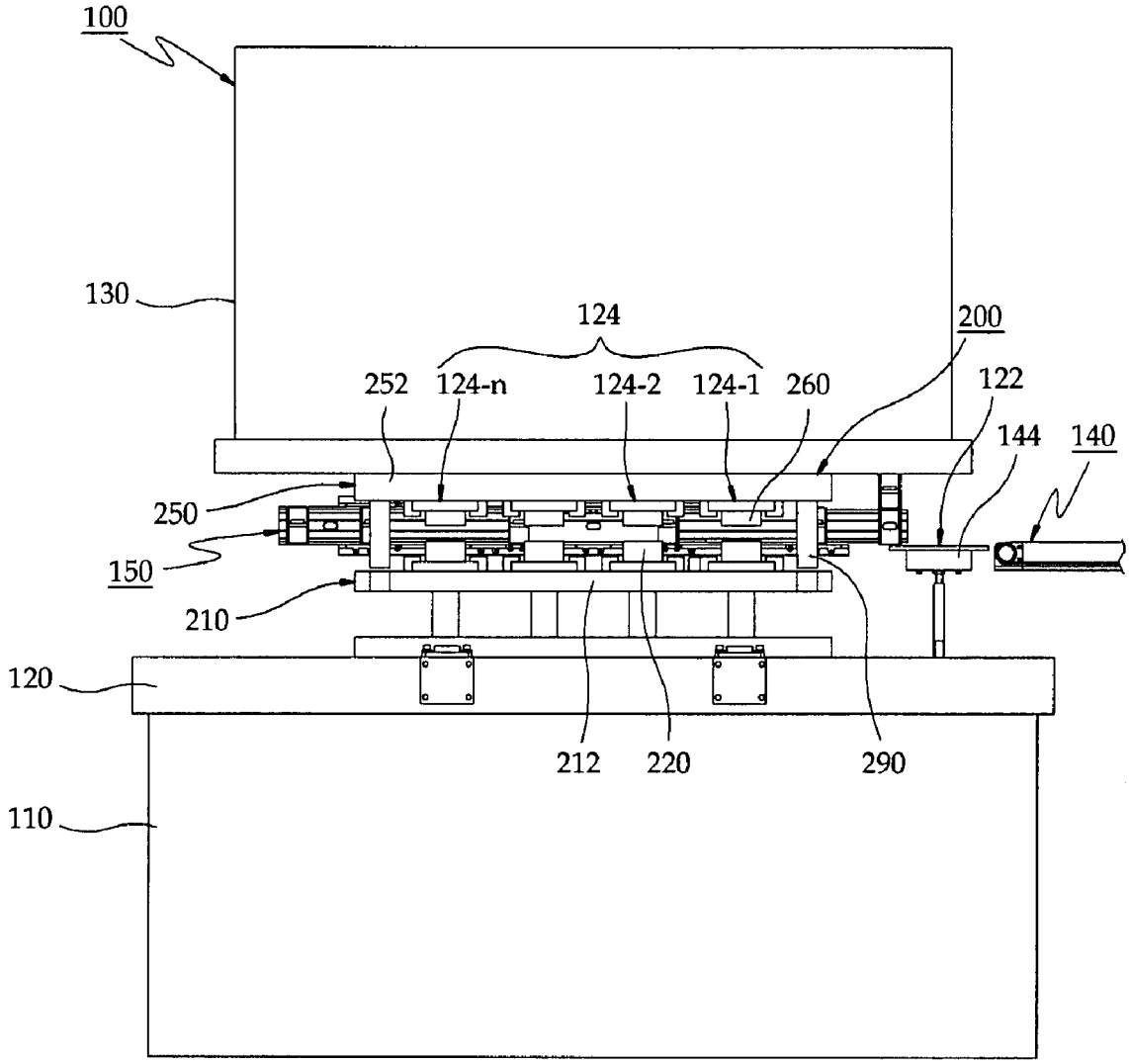
FIG. 2 is a front elevational view illustrating a press that incorporates the press die set in accordance with the present invention.
Figure 3:
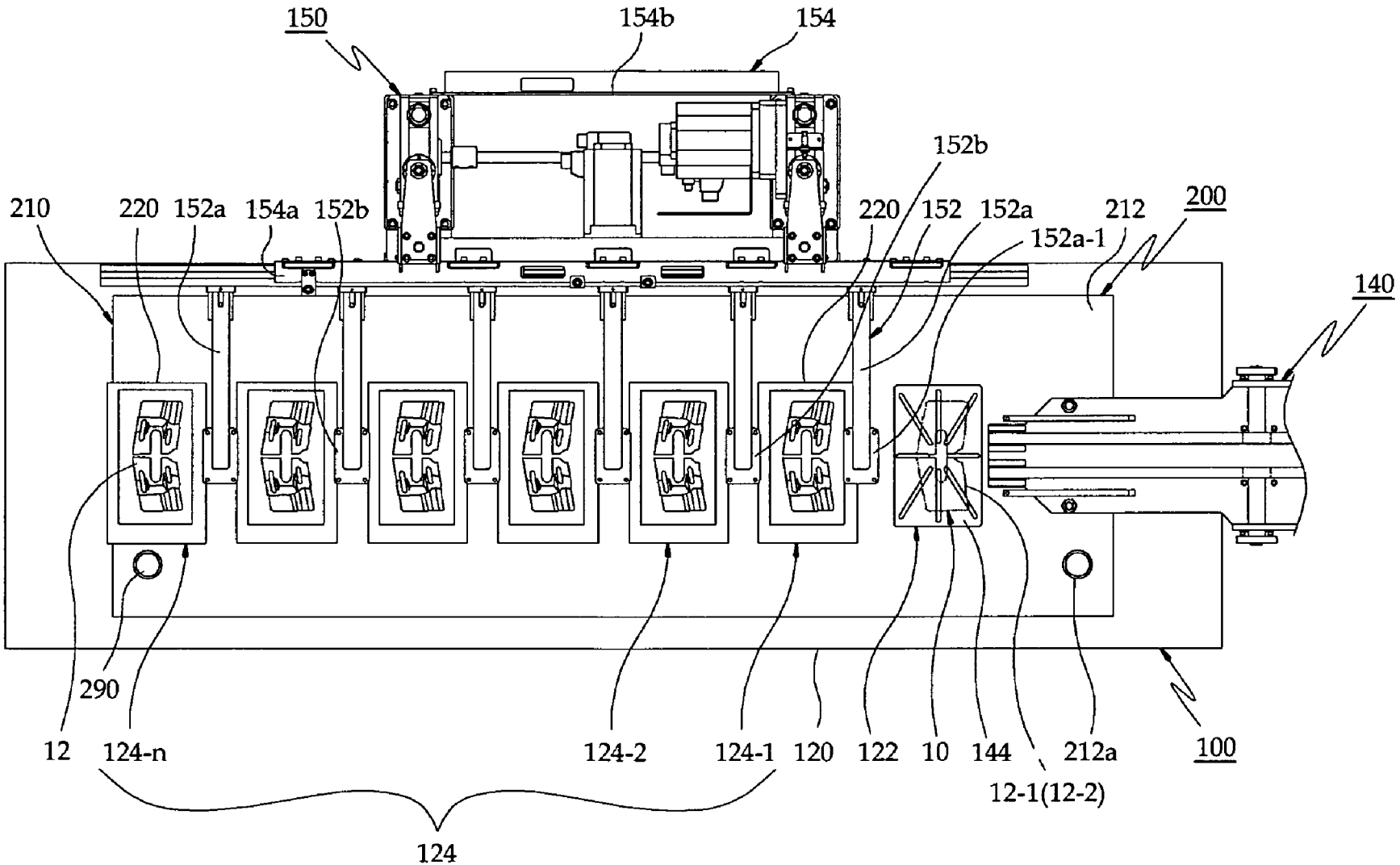
FIG. 3 is a top view illustrating the press, the press die set and a transfer feeder employed in the multi-step press system.

Referring first to FIGS. 1 to 3, a multi-step press system to which the press die set of an embodiment of the present invention is applied includes a single press 100. The press 100 is comprised of a press frame 110 serving as an outer shell, a table 120 attached to the press frame 110 and a ram 130 provided above the table 120 for rectilinear reciprocating movement in a Z-axis direction with respect to the table 120. Serially arranged on the table 120 in an X-axis direction are a standby station 122 into which workpieces 10 can be loaded one by one and a plurality of press-forming stations 124 (124-1 to 124-n) in which the workpieces 10 can be processed step by step into desired products.

For the purpose of processing blank workpieces 12 as one example of the workpieces 10, the standby station 122 is arranged on the table 120 so that it can lie adjacent to the upstream side of a first upstreammost press station (124-1) among the press-forming stations 124. The press 100 may be a well-known mechanical press in which the rectilinear reciprocating movement in the Z-axis direction of the ram 130 is caused by means of a drive mechanism including a crank, an eccentric, a toggle, a link, a cam and the like. Alternatively, the press 100 may be a well-known hydraulic press that relies upon a fluid pressure to cause the ram 130 to make rectilinear reciprocating movement in the Z-axis direction.

Referring to FIGS. 1 through 6, a lower die 210 and an upper die 250 of a press die set 200 are respectively attached to the table 120 and the ram 130 of the press 100 and are used in the multi-step processing of the workpieces 10 loaded into the press-forming stations 124. The lower die 210 has a base 212 bolted to the top surface of the table 120. A plurality of guide holes 212*a* and a plurality of mounting holes 212*b* are formed in the base 212 of the lower die 210.

Figure 4:
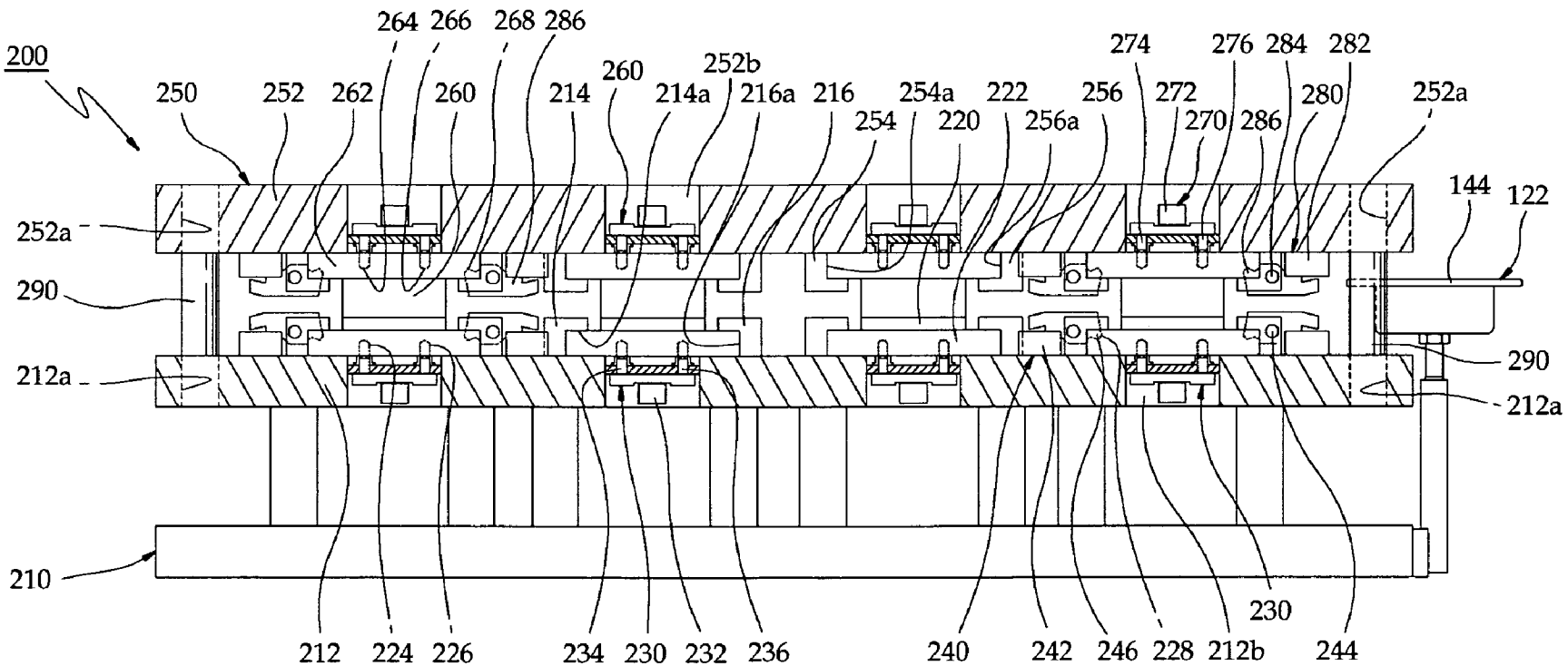
FIG. 4 is a sectional view showing the overall configuration of the press die set in accordance with an embodiment of the present invention.
Figure 5:
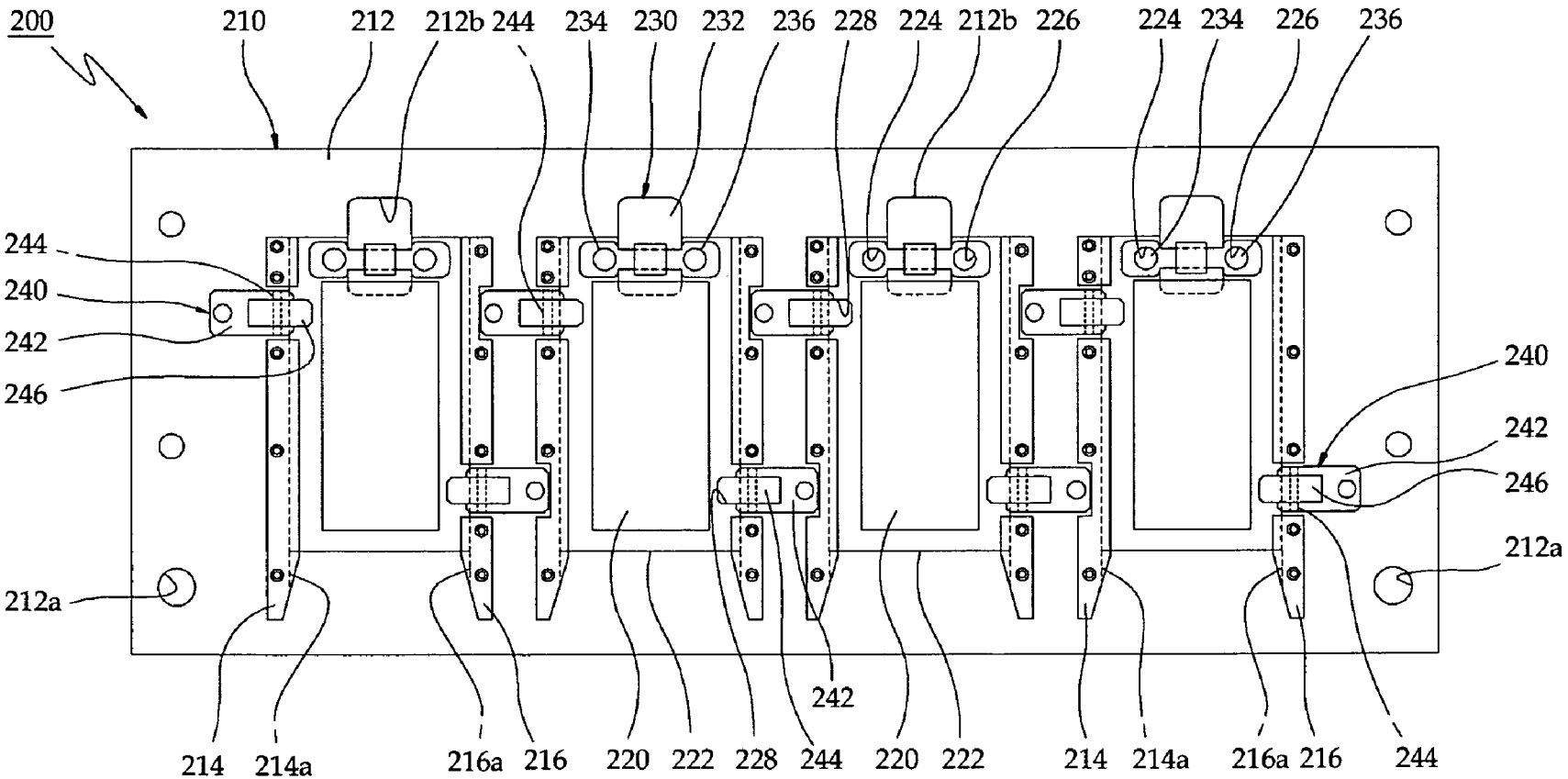
FIG. 5 is a top view depicting a lower die of the press die set in accordance with an embodiment of the present invention.

As can be seen in FIGS. 4 and 5, plural pairs of guide rails 214 and 216 are fixedly secured to the top surface of the base 212 along a Y-axis direction, each pair of guide rails 214 and 216 having mutually opposing grooves 214*a* and 216*a*. A plurality of die segments 220 for making direct contact with the workpieces 10 to press-form the workpieces into desired shapes are removably attached to the guide rails 214 and 216. Each of the die segments 220 has a slider plate 222 slidingly fitted into the grooves 214*a* and 216*a* of each pair of guide rails 214 and 216. The slider plate 222 has locator holes 224 and 226 in its rear end region and clamping holes 228 in its lateral side regions.

A plurality of first locators 230 for aligning the positions of the die segments 220 are mounted at the rear of the respective pairs of guide rails 214 and 216. Each of the first locators 230 includes an actuator 232 arranged inside each of the mounting holes 212*b* of the base 212 and a plurality of locator pins 234 and 236 provided such that they can be extended through the mounting holes 212*b* of the base 212 by virtue of the actuator 232 and fitted into locator holes 224 and 226 of the die segments 220. The actuator 232 may be a pneumatic type or an electric type.

On the opposite lateral sides of the respective pairs of guide rails 214 and 216, there are arranged clamping units 240 for clamping the die segments 220 against removal. Each of the clamping units 240 includes an actuator 242 mounted to the base 212 and a clamp 246 adapted to rotate about a pivot pin 244 by means of the actuator 242 and then to engage with the clamp holes 228 of the slider plate 222, thereby clamping the corresponding one of the die segments 220.

Figure 6:
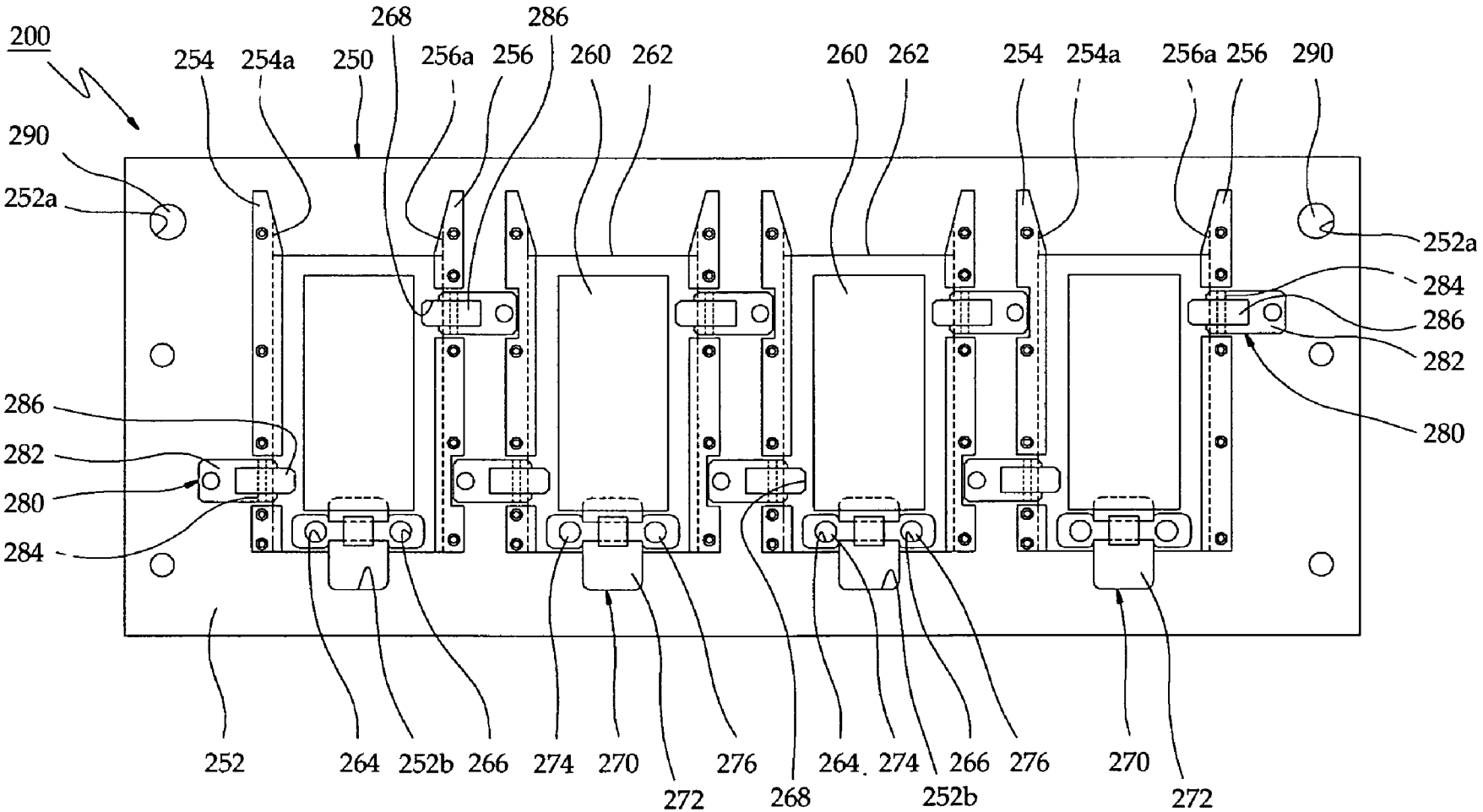
FIG. 6 is a bottom view depicting an upper die of the press die set in accordance with an embodiment of the present invention.

As shown in FIGS. 4 and 6, the upper die 250 is attached to the bottom surface of the ram 130 in an opposing relationship with the lower die 210. The upper die 250 includes a base 252, plural pairs of guide rails 254 and 256, second locators 270 and clamping units 280, all of which correspond in configuration to the base 212, the guide rails 214 and 216, the first locator 230 and the clamping units 240 of the lower die 210.

The base 252 of the upper die 250 is bolted to the bottom surface of the ram 130 and has guide holes 252*a* and mounting holes 252*b*. Plural pairs of guide rails 254 and 256 are fixedly secured to the bottom surface of the base 252 along a Y-axis direction, each pair of guide rails 254 and 256 having mutually opposing grooves 254*a* and 256*a*.

A plurality of die segments 260 for making direct contact with the workpieces 10 to press-form the workpieces into desired shapes are removably attached to the guide rails 254 and 256. Each of the die segments 260 has a slider plate 262 slidingly fitted into the grooves 254*a* and 256*a* of each pair of guide rails 254 and 256. The slider plate 262 has locator holes 264 and 266 in its rear end region and clamping holes 268 in its lateral side regions.

Furthermore, a plurality of second locators 270 for aligning the positions of the die segments 260 are mounted at the rear of the respective pairs of guide rails 254 and 256. Each of the second locators 270 includes an actuator 272 arranged inside each of the mounting holes 252*b* of the base 252 and a plurality of locator pins 274 and 276 provided such that they can be extended through the mounting holes 252*b* of the base 252 by virtue of the actuator 272 and fitted into locator holes 264 and 266 of the respective die segments 260. On the opposite lateral sides of the respective pairs of guide rails 254 and 256, there are arranged clamping units 280 for clamping the die segments 260 against removal. Each of the clamping units 280 includes an actuator 282 mounted to the base 252 and a clamp 286 adapted to rotate about a pivot pin 284 by means of the actuator 282 into engagement with the clamp holes 268 of the slider plate 262, thereby clamping the corresponding one of the die segments 260.

In the meantime, the base 212 of the lower die 210 and the base 252 of the upper die 250 are guided by guide posts 290 in a state that the guide posts 290 are slidingly fitted into the guide holes 212*a* and 252*a* of the bases 212 and 252. This ensures that, during the course of descending movement caused by the ram 130, the die segments 260 of the upper die 250 are precisely aligned with the die segments 220 of the lower die 210 to thereby press the workpieces 10 against the die segments 220 of the lower die 210. There is illustrated in FIG. 3 that the press-forming stations 124 (124-1 to 24-n) of the press 100 are provided in six places and further that the die segments 220 of the lower die 210 are respectively arranged in the six press-forming stations 124 (124-1 to 24-n). Moreover, there is illustrated in FIGS. 2 and 4 to 6 that the die segments 220 of the lower die 210 and the die segments 260 of the upper die 250 are respectively four in number. However, the present invention is not limited thereto and it may be possible to increase or decrease the number of the press-forming stations 124 (124-1 to 24-n), the die segments 220 of the lower die 210 and the die segments 260 of the upper die 250, if the need arises.

Referring to FIG. 1, the multi-step press system further includes a destacker 140 installed on one side of the press 100 for continuously loading the workpieces 10 one by one. The destacker 140 is designed to stack a large number of, e.g., blank workpieces 12 one atop another and continuously load the blank workpieces 12 into the standby station 122 of the press 100 one after another. A stand 144 for receiving and supporting the blank workpiece 12 is arranged in the standby station 122.

Referring back to FIGS. 1 through 3, the multi-step press system further includes a transfer feeder 150 for simultaneously transferring the blank workpieces 12 placed on the press-forming stations 124 of the press 100 and the stand 144.

The transfer feeder 150 is provided between the table 120 of the press 100 and the ram 130 in such a manner that it can be moved both in the X-axis direction, i.e., the loading direction of the blank workpieces 12, and in the Z-axis direction. The transfer feeder 150 includes a plurality of vacuum suction units 152 for simultaneously sucking up the blank workpieces 12 placed on the press-forming stations 124 of the press 100 and the stand 144 and a robot unit 154 for causing the vacuum suction units 152 to move in the X-axis and Z-axis directions of the press 100.

Each of the vacuum suction units 152 includes an arm 152*a* mounted for movement in the X-axis direction of the press 100 and a vacuum pad 152*b* attached to the tip end of the arm 152*a* for simultaneous vacuum suction of the respective blank workpieces 12 placed on the press-forming stations 124 of the press 100 and the stand 144.

The robot unit 154 includes an X-axis linear motion actuator 154*a* for causing the arm 152*a* to move in the X-axis direction of the press 100 and a Z-axis linear motion actuator 154*b* for causing the X-axis linear motion actuator 154*a* to move in the Z-axis direction of the press 100.

Referring again to FIG. 1, the multi-step press system further includes a numerically controlled leveler feeder 160 provided on the other side of the press 100 for loading a coil workpiece 14 in the form of a roll, another example of the afore-mentioned workpieces 12. The leveler feeder 160 includes an uncoiler 166 for unwinding the coil workpiece 14 held by a supply reel 162 through the operation of a pusher 164 and a leveler 168 for straightening the coil workpiece 14 supplied from the uncoiler 166 and then loading the same into the last downstreammost press-forming station 124-n among the press-forming stations 124 of the press 100. In this regard, the last press-forming station 124-n of the press 100 serves as a station wherein the coil workpiece 14 loaded by the leveler feeder 160 is blanked into the blank workpiece 12, i.e., a primary processing station.

The press 100, the destacker 140, the transfer feeder 150 and the leveler feeder 160 of the multi-step press system are operated under the sequence control of a control board 170. The control board 170 may be a computer capable of sequence-controlling the press 100, the destacker 140, the transfer feeder 150 and the leveler feeder 160 of the multi-step press system.

From now, description will be made on the operation of the press die set for a multi-step press system constructed as above.

First of all, steps of processing the blank workpiece 12, one example of the workpiece 10, into a desired product will be described with reference to FIGS. 1 through 6. The lower die 210 and the upper die 250 of the press die set 200 are respectively attached to the table 120 and the ram 130 of the press 100. Each of the die segments 220 of the lower die 210 is fixed in place by slidingly inserting the slider plate 222 thereof into between the grooves 214*a* and 216*a* of each pair of guide rails 214 and 216.

The actuator 232 of each of the first locators 230 is operated to extend the locator pins 234 and 236 into engagement with the locator holes 224 and 226 of the slider plate 222, thereby aligning the position of the respective die segments 220. Then, the actuator 242 of each of the clamping units 240 is operated to rotate the clamps 246 about the pivots 244, whereby the clamps 246 are fitted into the clamping holes 228 of the slider plate 222 to releasably clamp the corresponding die segment 220.

Just like the manner of fitting the die segments 220 of the lower die 210 as noted above, the segment dies 260 of the upper die 250 are fixed to the ram 130 of the press 100 by slidingly inserting the segment dies 260 into between the guide rails 254 and 256, having the second locators 270 align the position of the segment dies 260 and allowing the clamping units 240 to clamp the segment dies 260 against removal.

Use of the afore-mentioned arrangement by which the die segments 220 of the lower die 210 and the die segments 260 of the upper die 250 are fixed in place in a cartridge-like manner makes it possible for the operator to attach and remove the press die set 200 with ease. Furthermore, in case the die segments 220 and 260 are damaged in part, the damaged die segment alone can be replaced with a new one. This helps to shorten the time required in changing the press die set, thus enhancing the ease of work and the interchangeability of components. Moreover, the die segments 220 and 260 become structurally simple, thereby shortening the time period required in developing and designing the press die set and eventually reducing production costs.

Referring to FIGS. 1 and 2, a large number of blank workpieces 12 once press-formed at an earlier stage are stacked in the stacker 142 of the destacker 140. Then, the destacker 140 is operated to load the blank workpieces 12 stacked in the stacker 142 onto the stand 144 of the standby station 122 one by one.

If the first blank workpiece 12-1 is laid down on the stand 144 of the standby station 122, the X-axis linear motion actuator 154*a* of the robot unit 154 is operated to displace the arms 152*a* of the vacuum suction units 152 in the X-axis direction so that the first upstreammost vacuum pad 152*b*-1 among the vacuum pads 152*b* can be placed above and aligned with the stand 144. Then, the X-axis linear motion actuator 154*a* is stopped and the Z-axis linear motion actuator 154*b* is operated to lower down the arms 152*a*. The first vacuum pad 152*b*-1 descending together with the arms 152*a* sucks up the first blank workpiece 12-1 placed on the stand 144.

Once the first blank workpiece 12-1 is sucked up by the first vacuum pad 152*b*-1 of the vacuum suction units 152, the arms 152*a* are raised up by the Z-axis linear motion actuator 154*b*, after which Z-axis linear motion actuator 154*b* stops its operation. Then, the X-axis linear motion actuator 154*a* is operated again to displace the first vacuum pad 152*b*-1 in the X-axis direction so that the first vacuum pad 152*b*-1 can be placed above and aligned with the first press-forming station 124-1, after which X-axis linear motion actuator 154*a* stops its operation.

Next, the Z-axis linear motion actuator 154*b* is operated again to lower down the arms 152*a* and is stopped when the first vacuum pad 152*b*-1 descending together with the arms 152*a* comes closer to the die segment 220 of the lower die 210 placed in the first press-forming station 124-1. If the vacuum suction force of the first vacuum pad 152*b*-1 is removed in the state that the first vacuum pad 152*b*-1 lies adjacent to the die segment 220 of the lower die 210 placed in the first press-forming station 124-1, the first blank workpiece 12-1 sucked up by the first vacuum pad 152*b*-1 is laid down on the die segment 220. After the first blank workpiece 12-1 has been loaded in this manner, the X-axis linear motion actuator 154*a* and the Z-axis linear motion actuator 154*b* are operated to return the vacuum pads 152*b* to their initial positions in between the respective die segments 220.

Under the state that the first blank workpiece 12-1 is loaded onto the die segment 220 of the lower die 210 placed in the first press-forming station 124-1, the ram 130 is operated such that the ram 130 and the die segments 220 of the upper die 250 can move downwards to thereby press-form the first blank workpiece 12-1. During the time when the first blank workpiece 12-1 is press-formed by the operation of the ram 130, the destacker 140 is operated to load the second blank workpiece 12-2 onto the stand 144.

If the ram 130 moves upwards into its initial position after the first blank workpiece 12-1 has been press-formed, the X-axis linear motion actuator 154*a* and the Z-axis linear motion actuator 154*b* of the robot unit 154 are operated to bring the vacuum pads 152*b* of the vacuum suction units 152 into contact with the first blank workpiece 12-1 placed in the first press-forming station 124-1 and the second blank workpiece 12-2 laid on the stand 144. If the first blank workpiece 12-1 and the second blank workpiece 12-2 are sucked up by the vacuum pads 152*b* of the vacuum suction units 152, the X-axis linear motion actuator 154*a* and the Z-axis linear motion actuator 154*b* of the robot unit 154 are operated again to load the first blank workpiece 12-1 onto the die segment 220 of the lower die 210 placed in the second press-forming station 124-2, while loading the second blank workpiece 12-2 onto the die segment 220 of the lower die 210 placed in the first press-forming station 124-1. If the vacuum suction units 152 are operated to remove the vacuum suction forces of the vacuum pads 152*b*, the first blank workpiece 12-1 and the second blank workpiece 12-2 are laid down on the corresponding die segments 220 of the lower die 210.

The first blank workpiece 12-1 is sequentially transferred from one press-forming station to another by the transfer feeder 150 and press-formed step by step in the respective press-forming stations 124 by means of the die segments 220 of the lower die 210 and the die segments 260 of the upper die 250, eventually becoming a final product in the last press-forming station 124-n. The final product that has undergone the press-forming process is unloaded from the last press-forming station 124-n either manually or through the use of an unloader or an ejector well-known in the art.

As set forth above, the multi-step press system is designed to ensure that the blank workpieces 12 are accurately and smoothly loaded into the press-forming stations 124 one after another by means of the destacker 140 and the transfer feeder 150 and then press-formed into final products by virtue of the press 100 equipped with the press die set of an embodiment of the present invention. This helps to improve productivity and reduce production costs.

Referring again to FIGS. 1 through 3, the numerically controlled leveler feeder 160 is adapted to load the coil workpiece 14 into the press 100 in a direction opposite to the loading direction of the blank workpieces 12. The uncoiler 166 of the leveler feeder 160 serves to periodically unwind the coil workpiece 14 from the supply reel 162 through the operation of the pusher 164. The coil workpiece 14 thus unwound is straightened by the leveler 168 and then loaded onto the die segment 220 of the lower die 210 placed in the last downstreammost press-forming station 124-n of the press 100.

In the last press-forming station 124-n, the coil workpiece 14 is press-formed into a blank workpiece 12 by means of the die segment 220 of the lower die 210 and the die segment 260 of the upper die 250 of the present press die set. The blank workpiece 12 obtained from the coil workpiece 14 is sequentially transferred from the last press-forming station 124-n toward the first upstreammost press-forming station 124 by means of the transfer feeder 150. While passing through the respective press-forming stations 124 arranged on the upstream side of the last press-forming station 124-n, the blank workpiece 12 is press-formed into a final product by means of the respective die segments 220 of the lower die 210 and the respective die segments 260 of the upper die 250. The final product thus obtained is unloaded from the first press-forming station 124 either manually or through the use of an unloader. Use of the leveler feeder 160 makes it possible to feed the coil workpiece 14 as well as the blank workpieces 12, which helps to optimally construct a flexible manufacturing system depending on the shape of the workpieces 10 supplied.

As is apparent from the foregoing description, the press die set for a multi-step press system in accordance with an embodiment of the present invention ensures that the workpieces placed on a plurality of press-forming stations are simultaneously press-formed through a single pressing stroke and further that the die segments forming an upper die and a lower die of the press die set are readily attached and removed in a cartridge-like manner, thereby shortening the die change time, enhancing the ease of work and the interchangeability of components, helping to shorten the time period required in developing and designing a press die set, and eventually reducing the production costs.

The embodiments set forth hereinabove have been presented for illustrative purpose only and, therefore, the present invention is not limited to these embodiments. It will be understood by those skilled in the art that various changes and modifications may be made without departing from the scope of the invention defined in the claims.

What is claimed is:

1. A press die set for a multi-step press system wherein the press system is comprised of: a press including a table having a plurality of press-forming stations in which workpieces are sequentially press-formed, the press-forming stations being serially arranged in an X-axis direction, and a ram provided above the table for making rectilinear reciprocating movement in a Z-axis direction; and a transfer feeder provided between the table and the ram for simultaneously picking up the workpieces placed in the press-forming stations and transferring the workpieces in a downstream direction, the press die set comprising:

a lower die attached to the table and an upper die attached to the ram, the lower die and the upper die being adapted to simultaneously press-form the workpieces placed in the press-forming stations, wherein the lower die includes a first base attached to the table, plural pairs of first guide rails fixedly secured to a top surface of the first base and arranged in a Y-axis direction, each pair of first guide rails having mutually opposing grooves, a plurality of first die segments for making direct contact with the workpieces to press-form the workpieces into desired shapes, each of the first die segments having a slider plate removably inserted into the grooves of each pair of first guide rails, and a plurality of first clamping units provided on opposite lateral sides of each pair of first guide rails for clamping the slider plate of each of the first die segments against removal, and wherein the upper die includes a second base attached to the ram, plural pairs of second guide rails fixedly secured to a bottom surface of the second base and arranged in the Y-axis direction, each pair of second guide rails having mutually opposing grooves, a plurality of second die segments for making direct contact with the workpieces to press-form the workpieces into desired shapes, each of the second die segments having a slider plate removably inserted into the grooves of each pair of second guide rails, and a plurality of second clamping units provided on opposite lateral sides of each pair of second guide rails for clamping the slider plate of each of the second die segments against removal.

2. The press die set for a multi-step press system as recited in claim 1, wherein the lower die further comprises a plurality of first locators each arranged on a rear side of each pair of first guide rails for aligning a corresponding one of the first die segments in a predetermined position, and wherein the upper die further comprises a plurality of second locators each arranged on a rear side of each pair of second guide rails for aligning a corresponding one of the second die segments in a predetermined position.

3. The press die set for a multi-step press system as recited in claim 2, wherein the slider plate of each of the first die segments has a plurality of rear locator holes, each of the first locators including an actuator attached to the first base of the lower die and a plurality of locator pins adapted to be displaced by the actuator and inserted into the rear locator holes of the slider plate of each of the first die segments, and wherein the slider plate of each of the second die segments has a plurality of rear locator holes, each of the second locators including an actuator attached to the second base of the upper die and a plurality of locator pins adapted to be displaced by the actuator of each of the second locators and inserted into the rear locator holes of the slider plate of each of the second die segments.

4. The press die set for a multi-step press system as recited in claim 1, wherein the slider plate of each of the first die segments has a plurality of side clamping holes, each of the first clamping units including an actuator attached to the first base of the lower die and a plurality of clamps adapted to pivotally rotate into engagement with the side clamping holes of the slider plate of each of the first die segments to clamp each of the first die segments against removal, and wherein the slider plate of each of the second die segments has a plurality of side clamping holes, each of the second clamping units including an actuator attached to the second base of the upper die and a plurality of clamps adapted to pivotally rotate into engagement with the side clamping holes of the slider plate of each of the second die segments to clamp each of the second die segments against removal.

5. The press die set for a multi-step press system as recited in claim 2, wherein the slider plate of each of the first die segments has a plurality of side clamping holes, each of the first clamping units including an actuator attached to the first base of the lower die and a plurality of clamps adapted to pivotally rotate into engagement with the side clamping holes of the slider plate of each of the first die segments to clamp each of the first die segments against removal, and wherein the slider plate of each of the second die segments has a plurality of side clamping holes, each of the second clamping units including an actuator attached to the second base of the upper die and a plurality of clamps adapted to pivotally rotate into engagement with the side clamping holes of the slider plate of each of the second die segments to clamp each of the second die segments against removal.

* * * * *